US011713591B2

(12) United States Patent
Tanner

(10) Patent No.: US 11,713,591 B2
(45) Date of Patent: Aug. 1, 2023

(54) SYSTEMS, DEVICES, AND/OR METHODS FOR DRIVING POSTS

(71) Applicant: William R. Tanner, Reva, VA (US)

(72) Inventor: William R. Tanner, Reva, VA (US)

( * ) Notice: Subject to any disclaimer, the term of this patent is extended or adjusted under 35 U.S.C. 154(b) by 569 days.

(21) Appl. No.: 16/641,481

(22) PCT Filed: Jun. 29, 2018

(86) PCT No.: PCT/US2018/040451
§ 371 (c)(1),
(2) Date: Feb. 24, 2020

(87) PCT Pub. No.: WO2019/006399
PCT Pub. Date: Jan. 3, 2019

(65) Prior Publication Data

US 2021/0156168 A1 May 27, 2021

Related U.S. Application Data

(60) Provisional application No. 62/526,636, filed on Jun. 29, 2017.

(51) Int. Cl.

| | |
|---|---|
| ***E02D 7/10*** | (2006.01) |
| ***E02D 7/08*** | (2006.01) |
| ***E04H 17/26*** | (2006.01) |
| ***E02D 7/18*** | (2006.01) |

(52) U.S. Cl.
CPC ..... *E04H 17/263* (2013.01); *E02D 7/08* (2013.01); *E02D 7/10* (2013.01); *E02D 7/18* (2013.01)

(58) Field of Classification Search
CPC .... E02D 7/06; E02D 7/08; E02D 7/10; E04H 17/263; E04H 12/347
USPC ..... 405/231, 232, 255, 249; 173/112, 114, 173/91, 122, 124, 210, 212, 128
See application file for complete search history.

(56) References Cited

U.S. PATENT DOCUMENTS

| | | | | |
|---|---|---|---|---|
| 3,548,604 | A * | 12/1970 | Campbell | E02D 7/16 173/28 |
| 5,012,873 | A * | 5/1991 | Kennedy | E01F 9/619 173/53 |
| 2008/0199259 | A1* | 8/2008 | Cannon | E02D 7/10 405/232 |
| 2010/0089602 | A1* | 4/2010 | Tanner | E04H 17/263 173/27 |

(Continued)

FOREIGN PATENT DOCUMENTS

| | | | |
|---|---|---|---|
| EP | 1887167 | A2 * | 2/2008 |
| EP | 2159332 | A2 * | 3/2010 |
| GB | 2420367 | A * | 5/2006 |

(Continued)

*Primary Examiner* — Sunil Singh
(74) *Attorney, Agent, or Firm* — Dale Jensen, PLC; Dale Jensen

(57) ABSTRACT

Certain exemplary embodiments can provide a system comprising a frame, which comprises an outer mast and an inner mast. The outer mast slides along the inner mast. A motor is coupled to the frame. A hydraulic system is coupled to the motor. A jackhammer head is coupled to the outer mast, which outer mast allows the jackhammer head to float up and down on the inner mast as the jackhammer head reciprocates. Thereby vibrations from jackhammer motion substantially do not get transferred to the frame.

13 Claims, 13 Drawing Sheets

(56) References Cited

U.S. PATENT DOCUMENTS

| | | | | |
|---|---|---|---|---|
| 2013/0140053 | A1* | 6/2013 | Niekamp | E02D 7/08 173/93 |
| 2014/0345894 | A1* | 11/2014 | LaCoe | E02D 7/06 173/184 |

FOREIGN PATENT DOCUMENTS

| | | | |
|---|---|---|---|
| GB | 2536266 | A * | 9/2016 |
| WO | WO 00/31364 | * | 6/2000 |

* cited by examiner

1000

1000

3000

5000

7000

8000

9000

10000

11000

12000

SYSTEMS, DEVICES, AND/OR METHODS FOR DRIVING POSTS

CROSS-REFERENCES TO RELATED APPLICATIONS

This application claims priority to, and incorporates by reference herein in its entirety, U.S. Provisional Patent Application Ser. No. 62/526,636, filed Jun. 29, 2018.

BRIEF DESCRIPTION OF THE DRAWINGS

A wide variety of potential practical and useful embodiments will be more readily understood through the following detailed description of certain exemplary embodiments, with reference to the accompanying exemplary drawings in which:

FIG. 1B is a rear view of an exemplary embodiment of system 1000;

DETAILED DESCRIPTION

Certain exemplary embodiments can provide a system comprising a frame, which comprises an outer mast and an inner mast. The outer mast slides along the inner mast. A motor is coupled to the frame. A hydraulic system is coupled to the motor. A jackhammer head is coupled to the outer mast. Weight of the outer mast allows motion of the jackhammer head to drive the post. The outer mast allows the jackhammer head to float up and down on the inner mast as the jackhammer head reciprocates. Thereby vibrations from jackhammer motion substantially do not get transferred to the frame. The hydraulic system allows a user to adjust alignment of the outer mast and the post such that the post is driven into the earth in a substantially plumb orientation relative to the earth.

Certain exemplary embodiments provide a fence post driver, which can be used to improve the ease of installing a fence. The fence post driver can be made in any of several sizes depending upon the characteristics of posts to be driven and ground conditions. Certain exemplary embodiments and be constructed substantially from heavy-duty steel. Certain exemplary embodiments can be self-propelled. Certain exemplary embodiments can comprise an auger attachment that allows the fence post driver to drill holes as well as drive posts.

FIG. 1 illustrates four views of an exemplary embodiment of a system 1000. FIG. 1A is a frontal view, FIG. 1B is a side view, FIG. 1C is a rear view, and FIG. 1D is a top view. System 1000 comprises an outer mast 1200 and an inner mast 1100. Outer mast 1200 and inner mast 1100 are coupleable to a post driver system (see, e.g., system 3000 of FIG. 3).

Figure 1D:
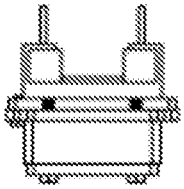
FIG. 1D is a top view of an exemplary embodiment of system 1000.
Figure 1A:
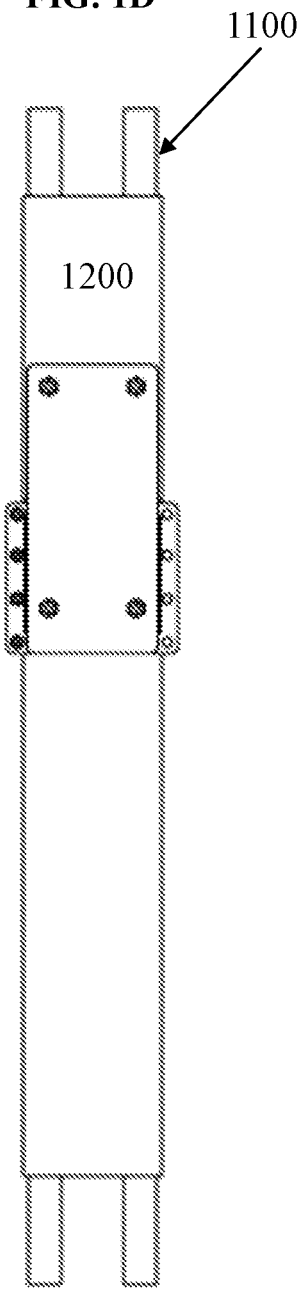
FIG. 1A is a plan view of an exemplary embodiment of a system 1000.
Figure 1B:
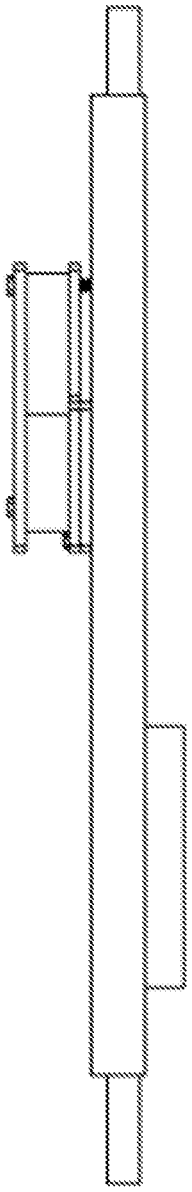
FIG. 1B is a side view of an exemplary embodiment of system 1000.
Figure 1C:
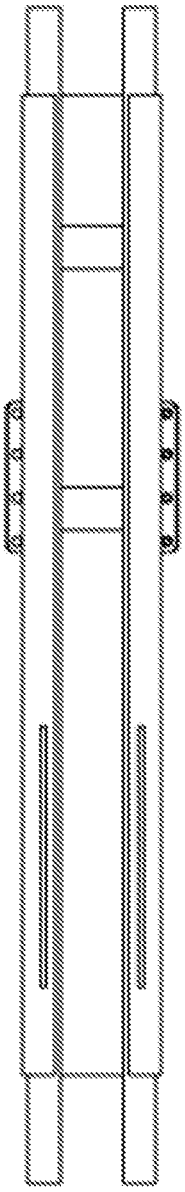
Figure 2A:
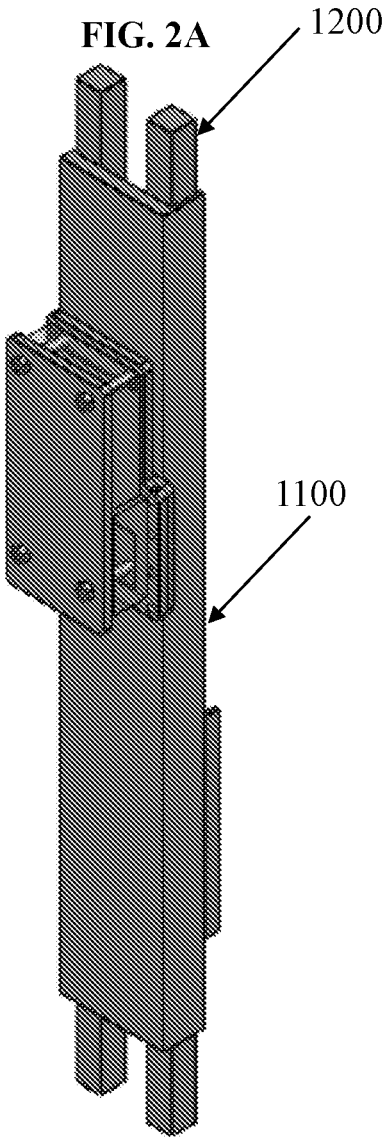
FIG. 2A is a perspective view in three dimensions of system 1000 with an outer mast in a lowered position relative to an inner mast.
Figure 2B:
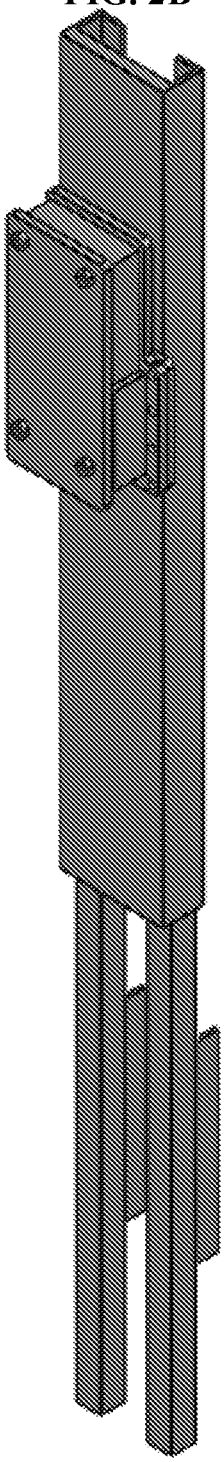
FIG. 2B is a perspective view in three dimensions of system 1000.

FIG. 2A and FIG. 2B illustrates two shaded perspective views of system 1000. System 1000 comprises an outer mast 1200 and an inner mast 1100. Outer mast 1200 and inner mast 1100 are coupleable to a post driver system (see, e.g., system 3000 of FIG. 3).

Figure 3:
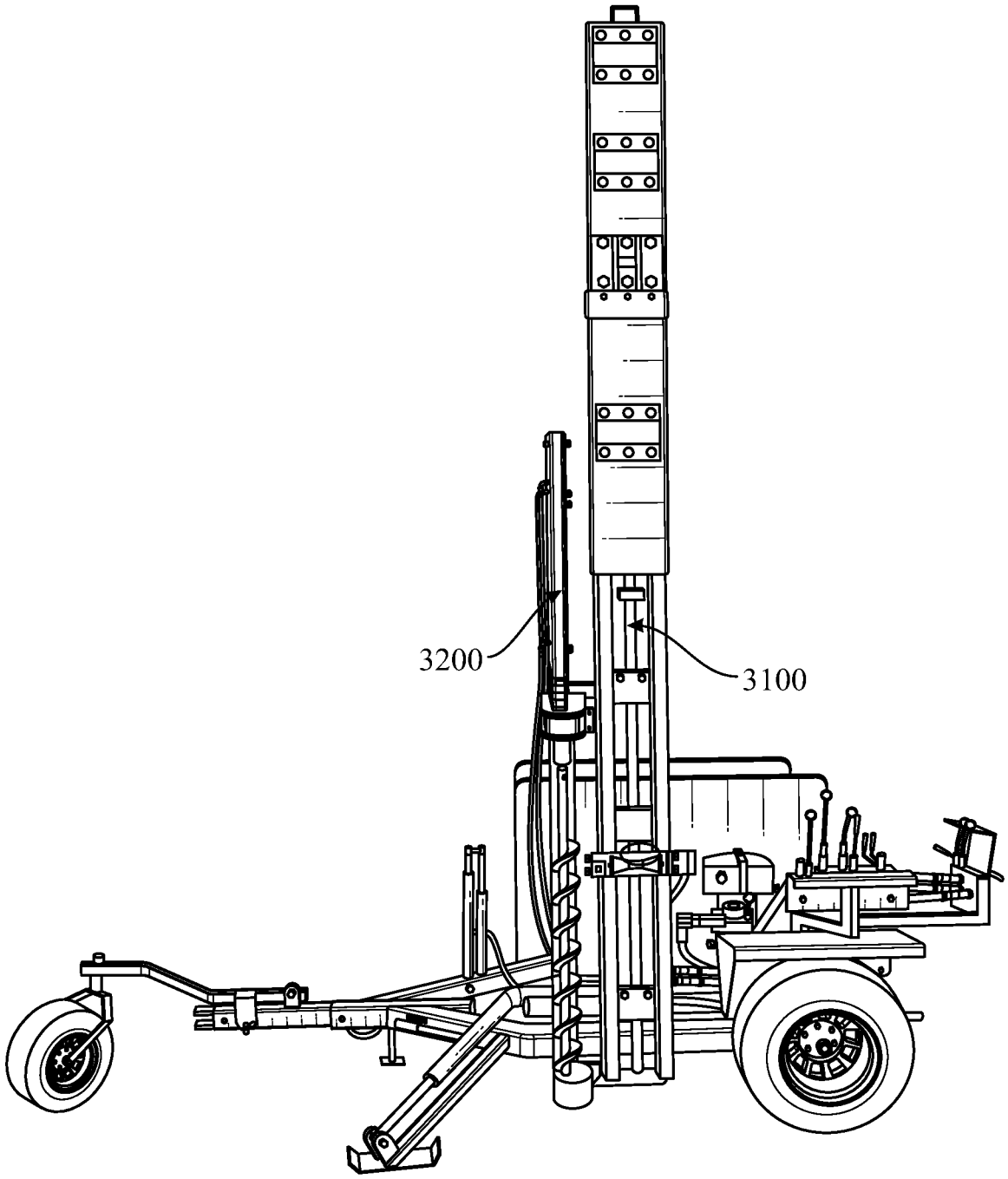
FIG. 3 is a perspective view of an exemplary embodiment of a system 3000.

FIG. 3 is a perspective view of an exemplary embodiment of a system 3000. Certain exemplary embodiments utilize an actuator 3100 to raise an outer mast to drive the posts. Certain exemplary embodiments utilize a hydraulic or pneumatic cylinder 3200 to cushion impacts caused by reciprocating motion of the actuator 3100.

Figure 4:
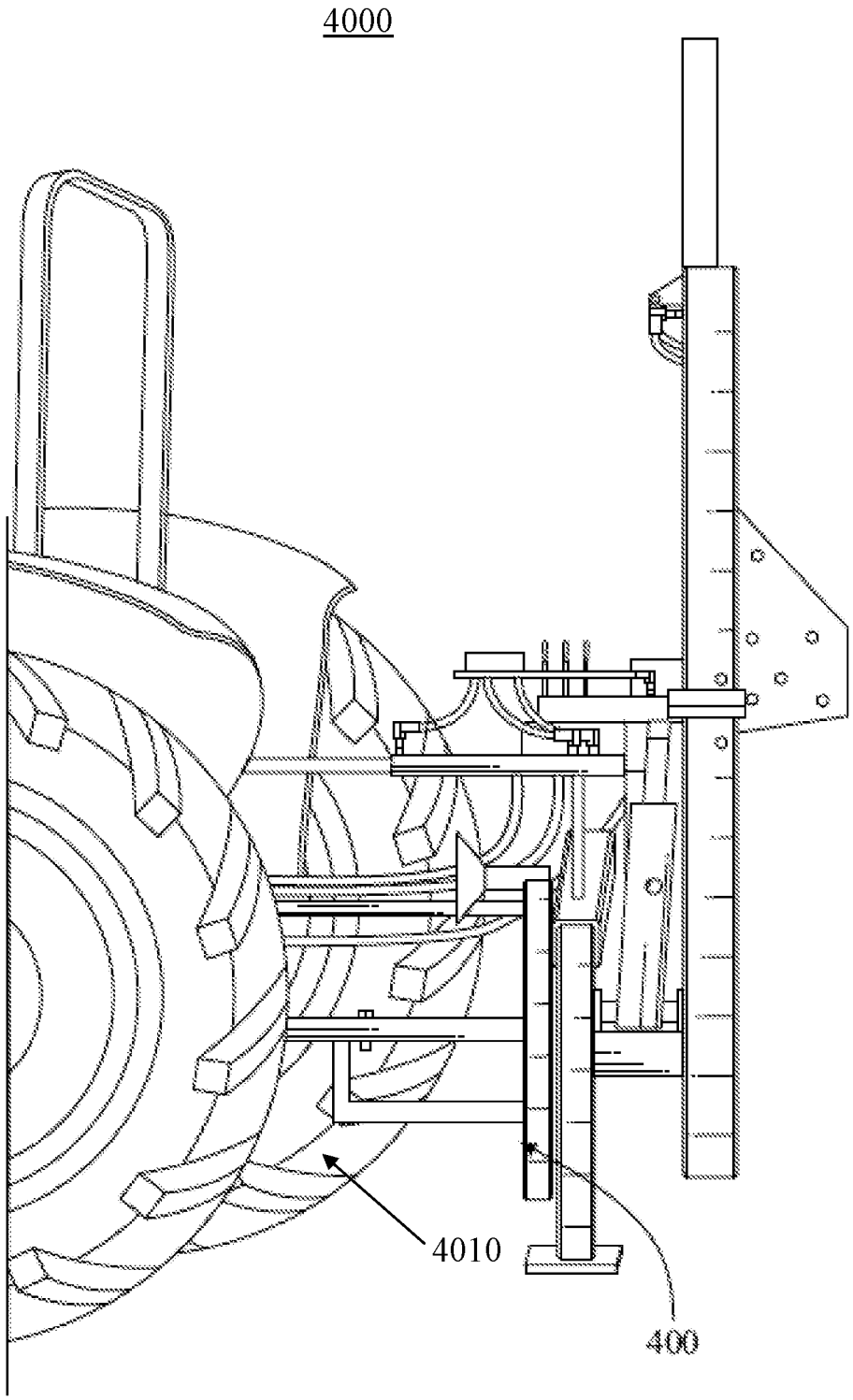
FIG. 4 is a perspective view of an exemplary embodiment of a system 4000.

FIG. 4 is a perspective view of an exemplary embodiment of a system 4000, which is constructed to be towed by a farm implement and/or vehicle 4010 such as a tractor. Such embodiments can have:

- a maximum post length of approximately 8 feet;
- a shipping weight of approximately 1,100 lbs;
- a hammer weight of approximately 650 lbs;
- overall dimensions of approximately 32 inches in length by 48 inches in width by 98 inches in height;
- a front to back tilt of approximately 40 degrees;
- a right to left tilt of approximately 50 degrees; and/or
- a stroke of approximately 66 inches.

Figure 5:
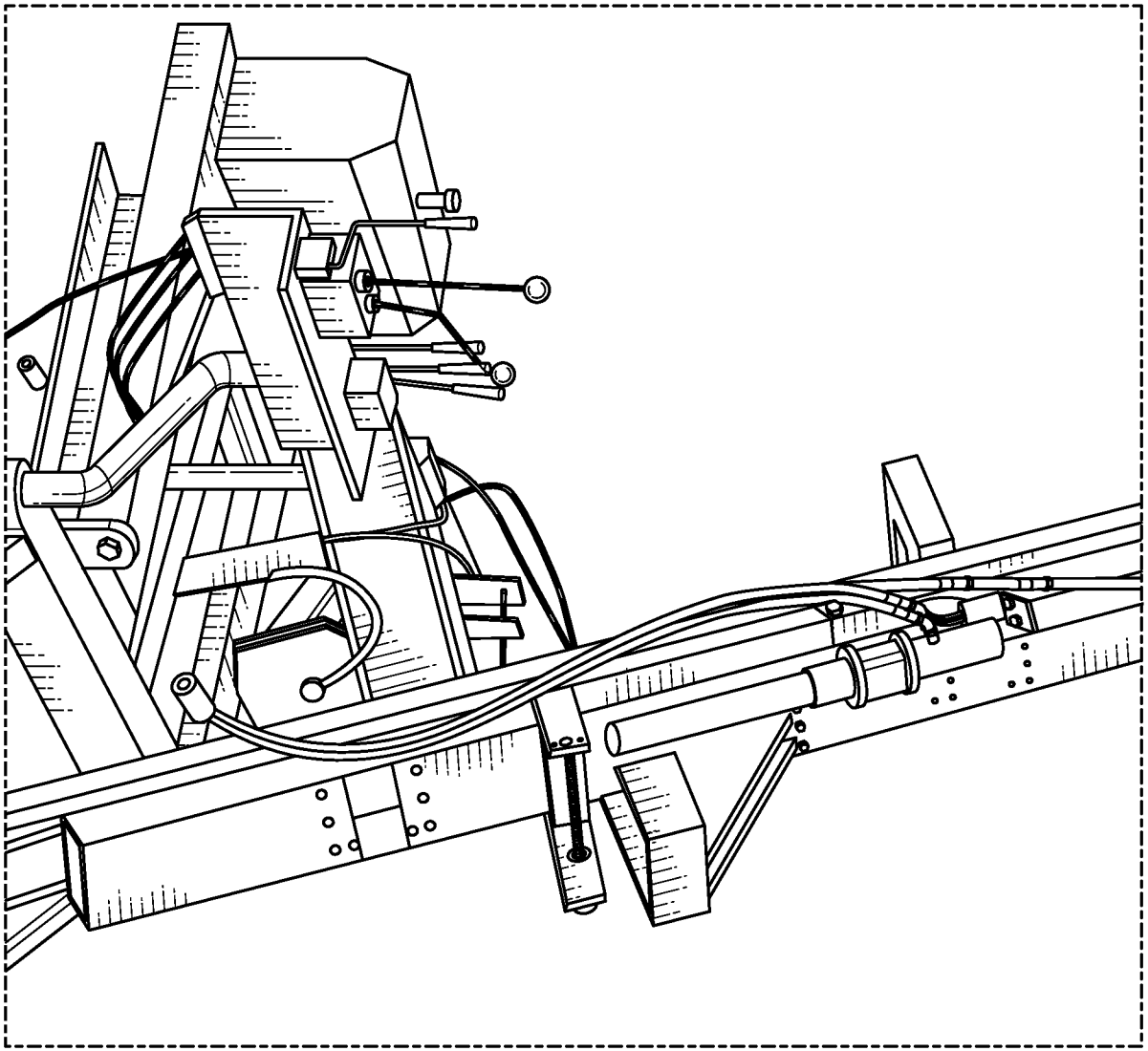
FIG. 5 is a perspective view of an exemplary embodiment of a system 5000.

FIG. 5 is a perspective view of an exemplary embodiment of a system 5000, which is constructed to be used for driving longer exemplary fence posts and comprises a single slide. Such embodiments can have:

- a post length of approximately 14 feet;
- a shipping weight of approximately 2,450 lbs;
- a hammer weight of approximately 750 lbs;
- overall dimensions of approximately 77 inches in length by 84 inches in width by 119 inches in height;
- a front to back tilt of approximately 26 degrees;
- a right to left tilt of approximately 40 degrees;
- a stroke of approximately 84 inches; and/or
- a slide to post feature in and out to post of approximately 16 inches.

Figure 6:
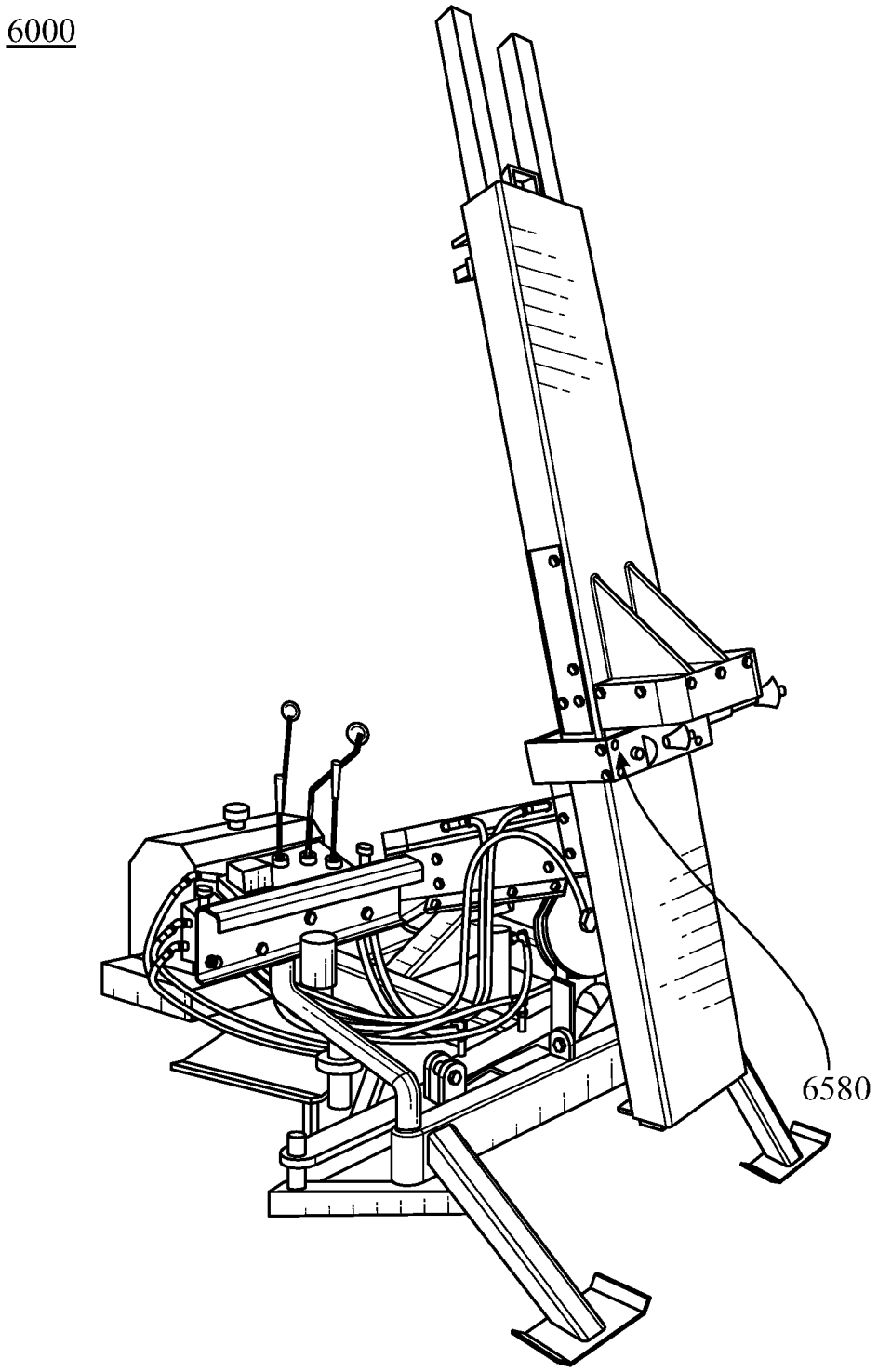
FIG. 6 is a perspective view of an exemplary embodiment of a system 6000.

FIG. 6 is a perspective view of an exemplary embodiment of a system 6000, which is a heavier duty model than system 5000 of FIG. 5 and comprises a double slide. System 6000 comprises an extendable member 6580. System 5000 can have improved versatility comparable to both system 4000 of FIG. 4 and system 5000 of FIG. 5. Such embodiments can have:

- a post length of approximately 14 feet;
- a shipping weight of approximately 2,700 lbs;
- a hammer weight of approximately 750 lbs;

overall dimensions of approximately 77 inches in length by 84 inches in width by 119 inches in height;
a front to back tilt of approximately 26 degrees;
a right to left tilt of approximately 40 degrees;
a stroke of approximately 84 inches; and/or
a slide to post feature in and out to post of approximately 16 inches.

Figure 7:
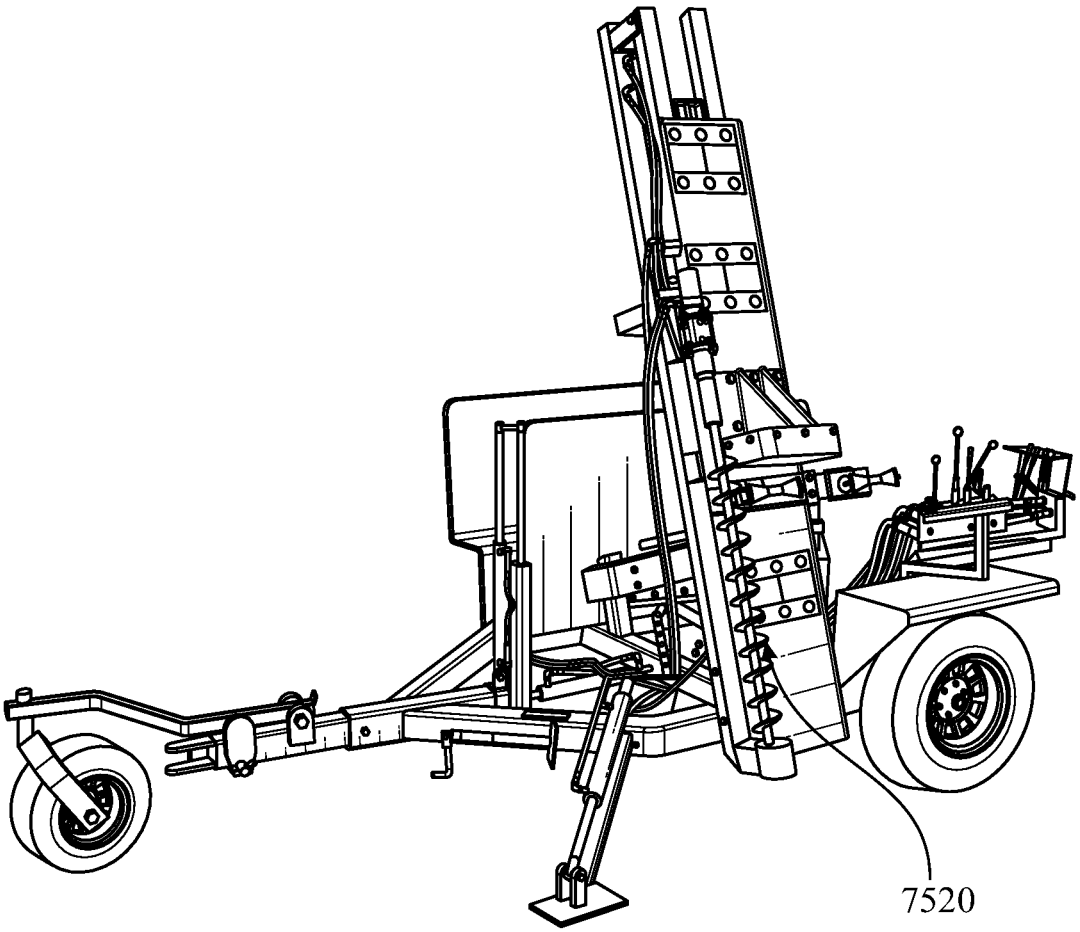
FIG. 7 is a perspective view of an exemplary embodiment of a system 7000.

FIG. 7 is a perspective view of an exemplary embodiment of a system 7000, which is a self-propelled model. System 7000 comprises an auger 7520. Such embodiments can have:
a heavy duty rating;
a hitch pin mount;
a post length of approximately 14 feet;
a shipping weight of approximately 3,700 lbs;
a hammer weight of approximately 750 lbs;
overall dimensions of approximately 126 inches in length by 90 inches in width by 119 inches in height;
a front to back tilt of approximately 30 degrees;
a right to left tilt of approximately 50 degrees;
a stroke of approximately 84 inches;
optional mud tires;
a slide out feature;
an in and out to post distance of approximately 16 inches; and/or
a forward and backward to post distance of approximately 16 inches.

Figure 8:
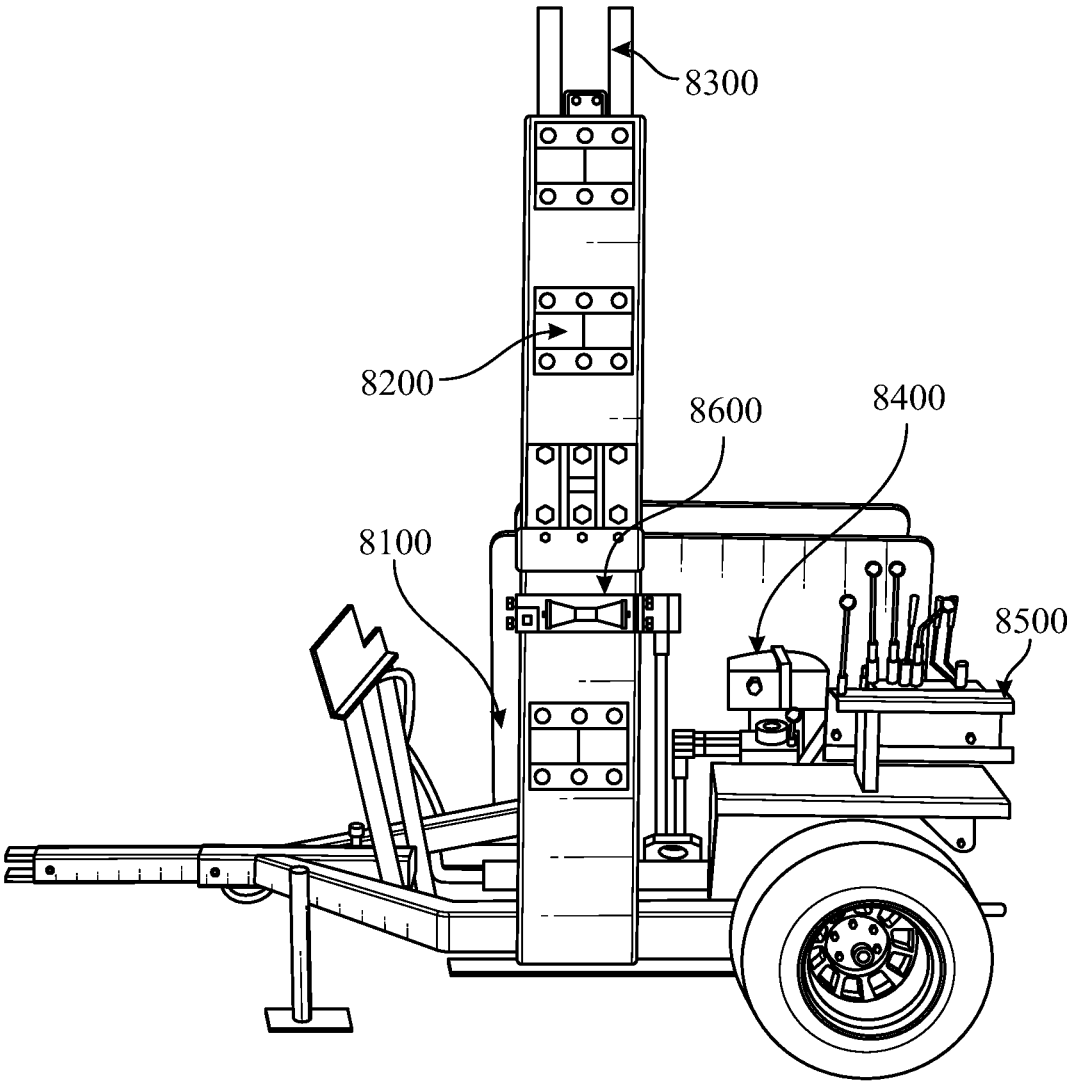
FIG. 8 is a perspective view of an exemplary embodiment of a system 8000.

FIG. 8 is a perspective view of an exemplary embodiment of a system 8000, which is a trailer-mounted model. Such embodiments can have:
a heavy duty rating;
a hitch pin mount;
a post length of approximately 14 feet;
a shipping weight of approximately 3,300 lbs;
a hammer weight of approximately 750 lbs;
overall dimensions of approximately 77 inches in length by 84 inches in width by 119 inches in height;
a front to back tilt of approximately 30 degrees;
a right to left tilt of approximately 50 degrees;
a stroke of approximately 84 inches;
a slide out feature;
an in and out to post distance of approximately 16 inches; and/or
a forward and backward to post distance of approximately 16 inches.

Certain exemplary embodiments provide:
a post storage tray;
an electric motor having a horsepower rating of approximately 13;
drive capability for guard rail posts; and/or
head keyways to reduce a probability of head bolt breakage.

Certain exemplary embodiments comprise a frame 8100. Frame 8100 comprises an outer mast 8200 and an inner mast 8300. Outer mast 8200 slides along inner mast 8300. System 8000 comprises:
a motor 8400 coupled to frame 8100;
a hydraulic system 8500 coupled to motor 8400;
an actuator (see, e.g., actuator 9900 illustrated in FIG. 9) coupled to outer mast 8200, which outer mast 8200 is constructed to float up and down on inner mast 8300 as the actuator rises and as outer mast 8200 falls, wherein vibrations from outer mast motion substantially do not transfer to frame 8100; and
a drive cap 8600 coupled to, and driven by, a weight of outer mast 8200, wherein, responsive to outer mast 8200 falling, drive cap 8600 drives a post (see, e.g., post 12940 of FIG. 12) into the earth via repeated reciprocating motion.

Figure 9:
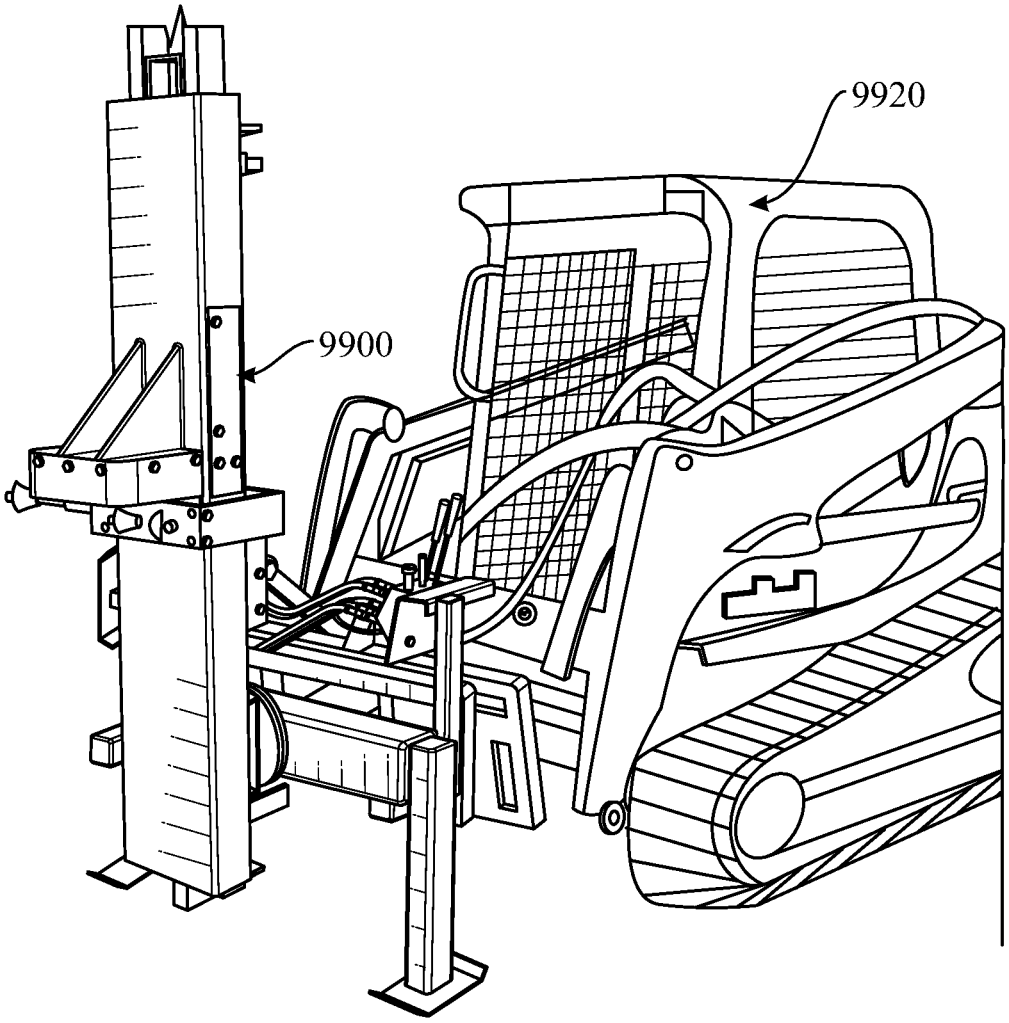
FIG. 9 is a perspective view of an exemplary embodiment of a system 9000.

FIG. 9 is a perspective view of an exemplary embodiment of a system 9000, which is constructed to be used as an attachment to a skid steer loader or the like. System 9000 comprises an actuator 9900 and is coupled to a skid steer loader 9920. Such embodiments can have:
a post length of approximately 8 feet;
a shipping weight of approximately 1,200 lbs;
a hammer weight of approximately 650 lbs;
overall dimensions of approximately 43 inches in length by 48 inches in width by 98 inches in height;
a front to back tilt of approximately 40 degrees;
a right to left tilt of approximately 50 degrees; and/or
a stroke of approximately 66 inches.

Figure 10:
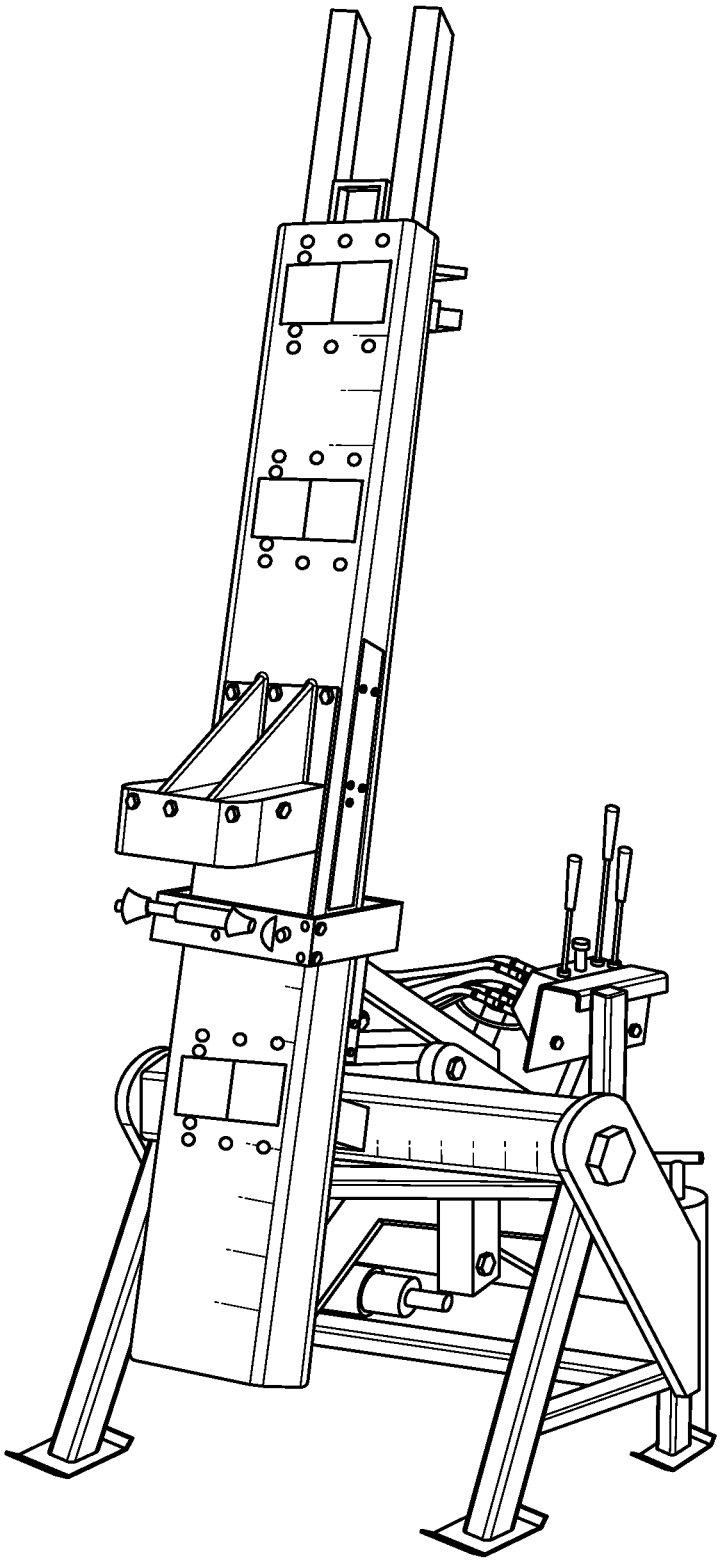
FIG. 10 is a perspective view of an exemplary embodiment of a system 10000.
Figure 11:
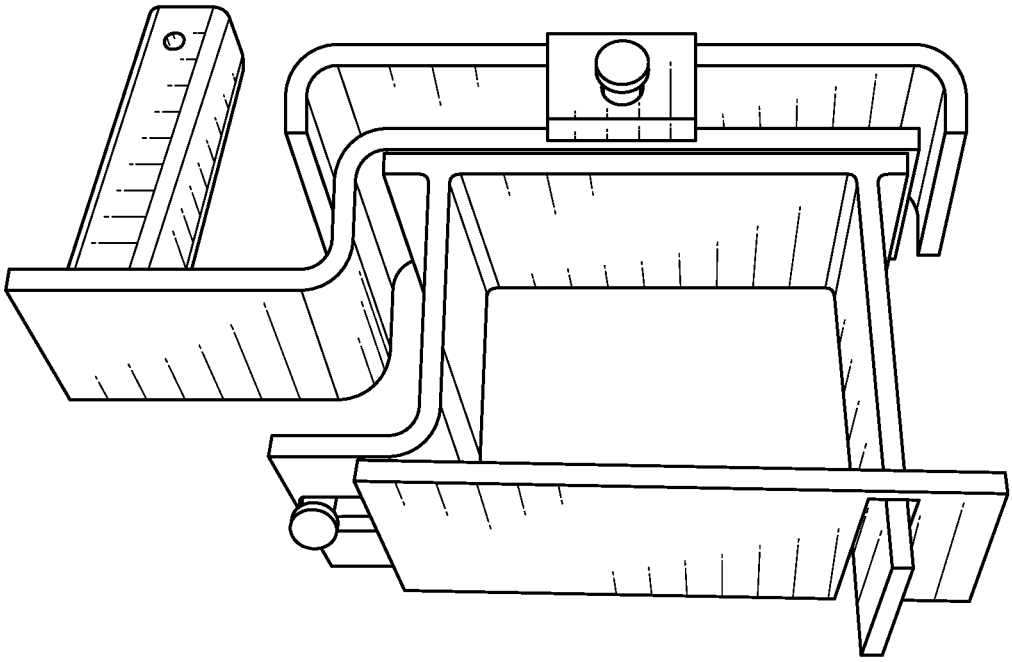
FIG. 11 is a perspective view of an exemplary embodiment of an optional accessory 11000.

FIG. 10 is a perspective view of an exemplary embodiment of a system 10000, which is constructed to be used as heavy-duty substantially freestanding unit. Such embodiments can have:
a post length of approximately 14 feet;
a shipping weight of approximately 1,650 lbs;
a hammer weight of approximately 750 lbs;
overall dimensions of approximately 43 inches in length by 48 inches in width by 98 inches in height;
a front to back tilt of approximately 26 degrees;
a right to left tilt of approximately 40 degrees; and/or
a stroke of approximately 84 inches FIG. 11 is a perspective view of an exemplary embodiment of an optional accessory 11000, which is a substantially square bracket adapter constructed to drive substantially square edge posts. Certain exemplary embodiments can provide an attachment that can allow attachment of a pilot auger.

Figure 12:
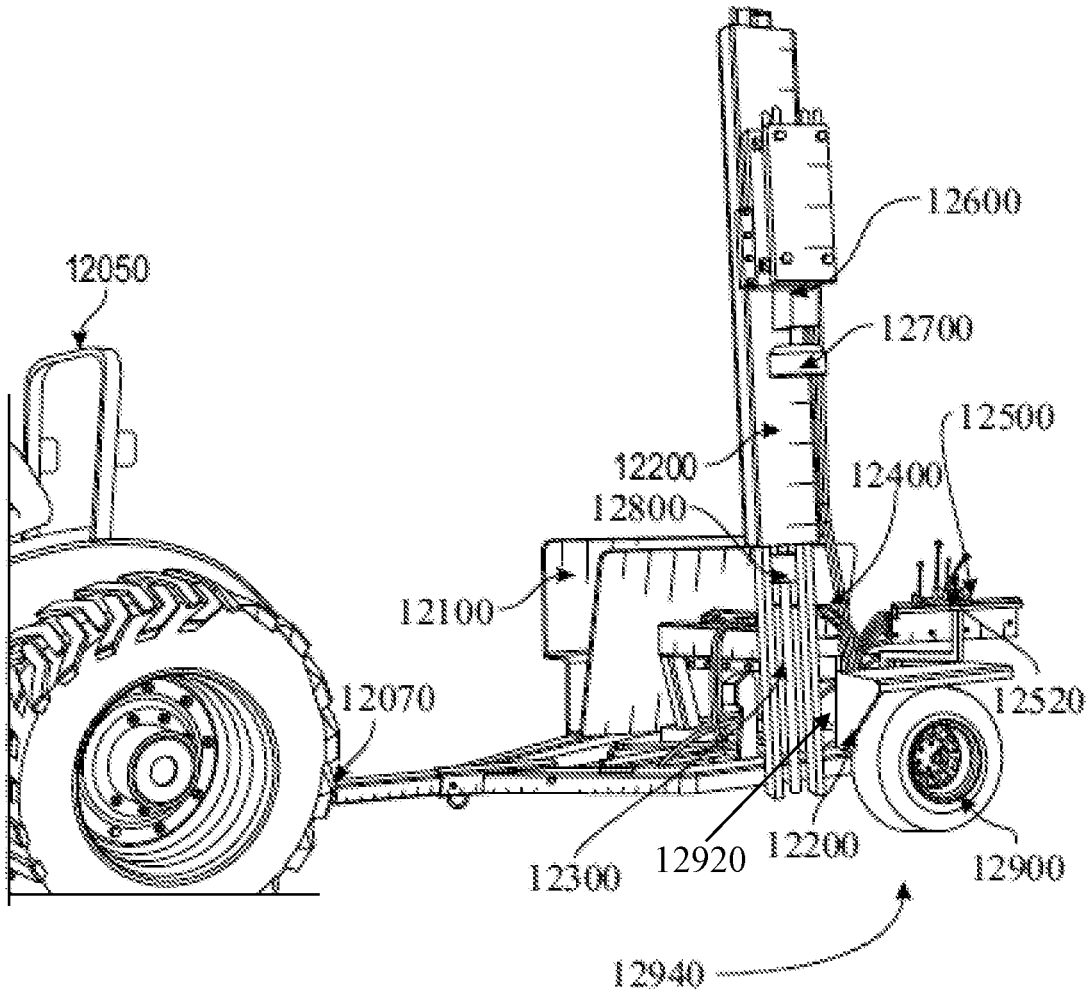
FIG. 12 is a perspective view of an exemplary embodiment of a system 12000.

FIG. 12 is a perspective view of an exemplary embodiment of a system 12000, which comprises;
a frame 12100, which comprises an outer mast 12200 and an inner mast 12300, wherein outer mast 12200 slides along inner mast 12300;
a motor 12400 coupled to frame 12100;
a hydraulic system 12500 coupled to motor 12400;
a jackhammer head 12600 coupled to outer mast 12200, which outer mast 12200 allows jackhammer head 12600 to float up and down on inner mast 12300, wherein vibrations from jackhammer motion substantially do not transfer from jackhammer head 12600 to frame 12100;
a drive cap 12700 coupled to, and driven by, jackhammer head 12600;
a hydraulic cylinder 12800 that cushions impacts caused by reciprocating motion of jackhammer head 12600;
an releasably coupleable auger (see, e.g., auger 7520 of FIG. 7), which is constructed to be operated via hydraulic system 12500, wherein the auger constructed to drill a hole in which the post is placed, wherein, when the auger is operatively coupled to system 12000 and/or hydraulic system 12500 causes the auger to rotate and thereby drill the hole;
a set of wheels 12900, wherein, responsive to a user action, hydraulic system 12500 is coupled to a drive 12920 that causes motion of system 12000 relative to the earth via rotation of set of wheels 12900;
in certain exemplary embodiments, set of wheels 12900 can be a set of mud tires, wherein, responsive to a user action, hydraulic system 12500 is coupled to drive 12920, which causes motion of system 12000 relative to the earth via rotation of set of wheels 12900;

a set of manually operated hydraulic valves 12520 that cause system hydraulic components to move, the system hydraulic components comprising jackhammer head 12600 a square bracket adapter (see, e.g., square bracket adapter 11000 of FIG. 11) coupleable to the frame, wherein the square bracket adapter is constructed to couple and/or align square edged posts to system 12000.

Responsive to a valve actuation, hydraulic system 12500 causes drive cap 12700 to drive a post into the earth via a repeatedly reciprocating motion of jackhammer head 12600. Repeatedly reciprocating motion causes drive cap 12700 to impact the post at a frequency of impact separated by less than approximately one tenth of a second.

In certain exemplary embodiments, drive cap 12700 is tapered such that the post is guided into the earth by drive cap 12700.

In certain exemplary embodiments, the frame comprises an extendable member (see, e.g., extendable member 6580 of FIG. 6), wherein hydraulic system 12500 causes the extendable beam to move linearly relative to other portions of frame 12100 to engage the post.

Certain exemplary systems can drive posts of up to 14 feet in length.

In certain exemplary embodiments, frame 12100 is coupled to a skid steer loader (see, e.g., skid steer loader 9920 of FIG. 9).

In certain exemplary embodiments, frame 12100 is coupled to a tractor 12050 via a three point hitch 12070.

A weight of outer mast 12200 allows motion of jackhammer head 12600 to drive the post. Outer mast 12200 allows jackhammer head 12600 to float up and down on inner mast 12300 as jackhammer head 12600 reciprocates. Thereby vibrations from jackhammer motion substantially do not get transferred to frame 12100. Hydraulic system 12500 allows a user to adjust alignment of outer mast 12200 and the post such that the post is driven into the earth in a substantially plumb orientation relative to the earth.

Figure 13:
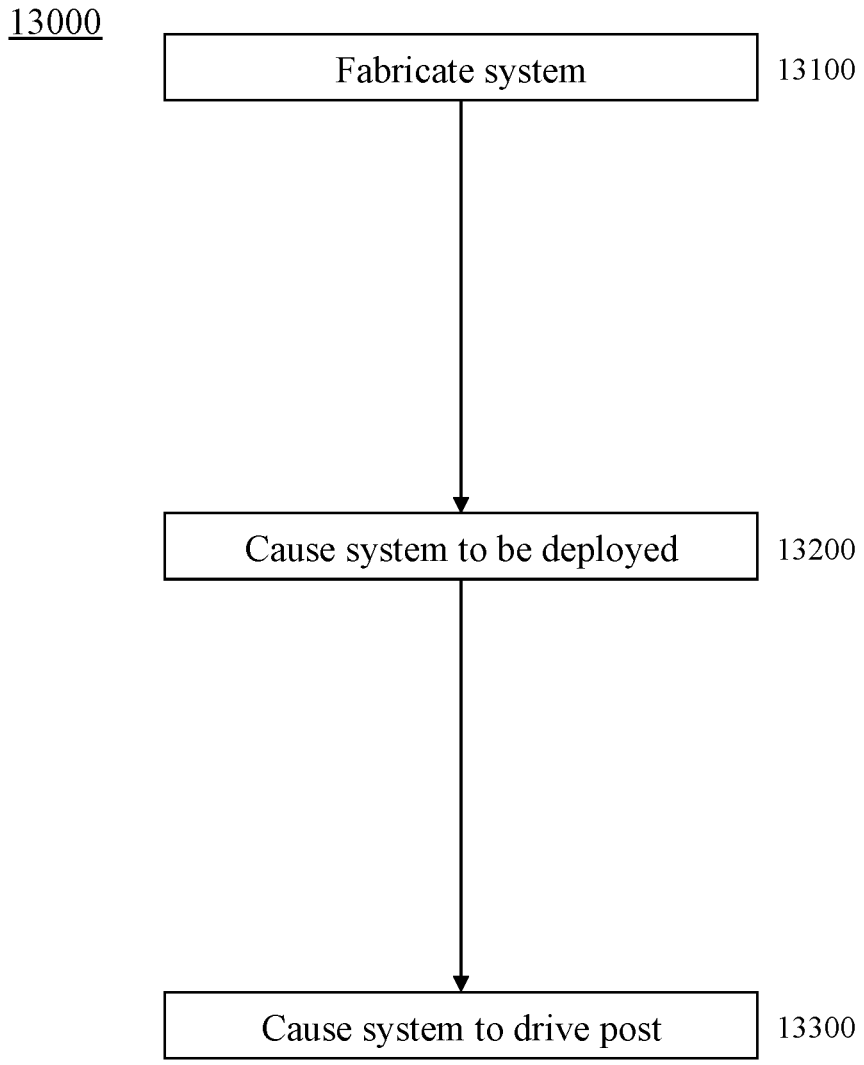
FIG. 13 is a flowchart of an exemplary embodiment of a method 13000.

FIG. 13 is a flowchart of an exemplary embodiment of a method 13000. At activity 13100, a post driver system can be fabricated. The post driver system can comprise a jackhammer. Impacts of the jackhammer can be cushioned by a cylinder comprised by the system. At activity 13200, certain exemplary embodiments can cause the system to be deployed to drive posts. At activity 13300, certain exemplary embodiments can cause the system to drive one or more posts via the jackhammer.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

action—something done.

activity—an action, act, step, and/or process or portion thereof.

actuate—to put into mechanical action or motion.

actuator—a mechanical device that uses energy to produce a force in a reciprocating linear motion.

adapter—a device used to effect operative compatibility between different parts of one or more pieces of an apparatus or system.

and/or—either in conjunction with or in alternative to.

apparatus—an appliance or device for a particular purpose.

associate—to join, connect together, and/or relate.

auger—a drill constructed to bore holes in the earth.

bracket—a device coupleable to a surface that supports a component.

can—is capable of, in at least some embodiments.

cause—to bring about.

circuit—an electrically conductive pathway and/or a communications connection established across two or more switching devices comprised by a network and between corresponding end systems connected to, but not comprised by the network.

comprising—including but not limited to.

configure—to make suitable or fit for a specific use or situation.

connect—to join or fasten together.

constructed to—made to and/or designed to.

convert—to transform, adapt, and/or change.

coupleable—capable of being joined, connected, and/or linked together.

couple—to link in some fashion.

cushion—to reduce effects of impacts on something.

cylinder—a cylindrical chamber in which the pressure of a gas or liquid moves a sliding piston.

cylindrical—having a shape of a surface or solid bounded by two parallel planes and generated by a straight line moving parallel to the given planes and tracing a curve bounded by the planes and lying in a plane perpendicular or oblique to the given planes.

define—to establish the outline, form, or structure of.

determine—to obtain, calculate, decide, deduce, and/or ascertain.

device—a machine, manufacture, and/or collection thereof.

drill—to make an aperture via boring with a bit.

drive—to impart a forward motion to by physical force.

drive cap—a device comprising a substantially planar sheet of material having a thickness, wherein the substantially planar sheet of material is constructed to engage and drive a post.

edge—an outside limit of an object, area, or surface.

engage—to be in contact and interact with.

extend—to cause to have a longer length.

frame—a supporting structure.

frequency—the number of times a specified periodic phenomenon occurs within a specified interval.

hole—an aperture in a surface.

hydraulic cylinder—a mechanical device that is used to move via a unidirectional force through a unidirectional stroke.

impact—an action of one object coming forcibly into contact with another.

install—to connect or set in position and prepare for use.

jackhammer head—a pneumatic hammer or drill that utilizes a reciprocating motion.

linearly—in a substantially straight line.

may—is allowed and/or permitted to, in at least some embodiments.

manual—via user action.

member—a structural unit.

method—a process, procedure, and/or collection of related activities for accomplishing something.
motion—a process via which something changes position from one location to another.
motor—a device powered by fossil fuel, hydrogen, and/or electrical energy that produces or imparts motion.
move—to travel from a first position to a second position.
mud tires—a ring-shaped component that surrounds a wheel's rim to transfer a vehicle's load from the axle through the wheel to the earth and to provide traction on an off-road surface traveled over. Mud tires are characterized by large tread blocks separated by wide gaps.
operate—to control a function of.
operatively coupled—joined in a manner that allows a system to function.
place—to put something in a predetermined location.
plumb—substantially vertical relative to the earth's surface.
plurality—the state of being plural and/or more than one.
portion—a part of a whole.
post—a piece of a material such as timber or metal set upright in the earth and used to support something.
post driver—a system that pushes posts into the earth.
predetermined—established in advance.
project—to calculate, estimate, or predict.
provide—to furnish, supply, give, and/or make available.
receive—to get as a signal, take, acquire, and/or obtain.
reciprocating motion—a repetitive up-and-down linear change of position over time.
repeatedly—again and again; repetitively.
request—to express a desire for and/or ask for.
responsive—reacting to an influence and/or impetus.
rotate—to move or cause to move around an axis or center.
separated—spaced in time.
set—a related plurality.
skid steer loader—a rigid-frame, engine-powered machine with lift arms used to attach a wide variety of tools and/or attachments.
square—having at least one cross-section shaped as a rectangle with all four sides having a substantially equal length.
store—to place, hold, and/or retain.
substantially—to a great extent or degree.
support—to bear the weight of, especially from below.
system—a collection of mechanisms, devices, machines, articles of manufacture, processes, data, and/or instructions, the collection designed to perform one or more specific functions.
three point hitch—a type of coupling that utilizes three separate attachment locations, the hitch constructed for attaching implements to a tractor.
tractor—an engineering vehicle specifically designed to deliver at a high tractive effort (or torque) at slow speeds, for the purposes of hauling a trailer or machinery used in agriculture or construction.
transmit—to send, provide, furnish, and/or supply.
user—any person, organization, process, device, program, protocol, and/or system that uses a device and/or service.
valve—a device by which the flow of a fluid is started, stopped, and/or regulated by a movable part that opens, shuts, or partially obstructs one or more ports or passageways.
via—by way of and/or utilizing.
wheel—a solid disk or a rigid circular ring connected by spokes to a hub, designed to turn around an axle passed through the center.

NOTE

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a frame, the frame comprising an outer mast and an inner mast, wherein the outer mast slides along the inner mast;

a motor coupled to the frame;

a hydraulic system coupled to the motor;

a jackhammer head coupled to the outer mast, which outer mast allows the jackhammer head to float up and down on the inner mast, thereby vibrations from jackhammer motion substantially do not transfer from the jackhammer head to the frame;

a drive cap coupled to, and driven by, the jackhammer head, wherein:

responsive to a valve actuation, the hydraulic system causes the drive cap to drive a post into the earth via a repeatedly reciprocating motion of the jackhammer head;

the repeatedly reciprocating motion causes the drive cap to impact the post at a frequency of impact separated by less than one tenth of a second;

wherein:

the system is capable of driving a post having a length that is in excess of eight feet; and the drive cap has a stroke of over eighty inches.

2. The system of claim 1, wherein:

the drive cap is tapered such that the post is guided into the earth by the drive cap.

3. The system of claim 1, further comprising:

a hydraulic cylinder that cushions impacts caused by reciprocating motion of the jackhammer head.

4. The system of claim 1, further comprising:

a releasably coupleable auger constructed to be operated via the hydraulic system, the auger constructed to drill a hole in which the post is placed, wherein, when the auger is operatively coupled to the system, the hydraulic system causes the auger to rotate and thereby drill the hole.

5. The system of claim 1, further comprising:

a set of wheels, wherein, responsive to a user action, the hydraulic system is coupled to a drive that causes motion of the system relative to the earth via rotation of the set of wheels.

6. The system of claim 1, further comprising:

a set of mud tires, wherein, responsive to a user action, the hydraulic system is coupled to a drive that causes motion of the system relative to the earth via rotation of the set of mud tires.

7. The system of claim 1, further comprising:

a set of manually operated hydraulic valves that cause said valve actuation.

8. The system of claim 1, further comprising:

a square bracket adapter coupleable to the frame, wherein the square bracket adapter is constructed to couple square edged posts to the system.

9. The system of claim 1, wherein:

the frame comprises an extendable member, wherein the hydraulic system causes the extendable member to move linearly relative to other portions of the frame to engage the post.

10. The system of claim 1, wherein:

the post has a length of up to 14 feet in length.

11. The system of claim 1, wherein:

the frame is coupled to a skid steer loader.

12. The system of claim 1, wherein:

the frame is coupled to a tractor via a three point hitch.

13. A system comprising:

a frame, the frame comprising an outer mast and an inner mast, wherein the outer mast slides along the inner mast;

a motor coupled to the frame;

a hydraulic system coupled to the motor;

an actuator coupled to the outer mast, which outer mast is constructed to float up and down on the inner mast as the actuator rises and as the outer mast falls, thereby vibrations from outer mast motion substantially do not transfer to the frame;

a drive cap coupled to, and driven by, a weight of the outer mast, wherein, responsive to the outer mast falling, the drive cap drives a post into the earth via repeated reciprocating motion of the drive cap;

wherein:

the system has a front to back tilt in excess of 25 degrees; and the system has a right to left tilt of in excess of 35 degrees.

* * * * *